US005558122A

United States Patent [19]

Kawamura et al.

[11] Patent Number: 5,558,122

[45] Date of Patent: Sep. 24, 1996

[54] ELECTRIC SIGNALS SUPPLYING DEVICE IN SOLENOID VALVE

[75] Inventors: Takahide Kawamura, Mizuhomachi; Kazuo Kotsuji, Kiyose, both of Japan

[73] Assignee: Koganei Corporation, Tokyo, Japan

[21] Appl. No.: 505,871

[22] Filed: Jul. 24, 1995

[30] Foreign Application Priority Data

Jul. 26, 1994 [JP] Japan ..... 6-174032

[51] Int. Cl.[6] ..... F15B 13/043

[52] U.S. Cl. ..... 137/596.17; 137/625.64; 439/189

[58] Field of Search ..... 137/596.17, 625.64; 439/49, 189

[56] References Cited

FOREIGN PATENT DOCUMENTS 4-129981 11/1992 Japan .

*Primary Examiner*—Gerald A. Michalsky

[57] ABSTRACT

An electric signals supplying device in a solenoid valve, wherein two solenoid coils are provided for operating respective valve members, is disclosed. This electric signals supplying device has a socket which has four conducting pins in total, including two conducting pins connected to a terminal on one of the polarities of the two solenoid coils and constituting a first pair, and two conducting pins connected to a terminal on the other of the polarities and constituting a second pair. A connector detachably provided on the said socket is detachably provided with four contacts in correspondence with the four conducting pins. The two conducting pins connected to the terminal on one of the polarities and constituting the first pair are electrically connected to each other through a short circuit member. The two conducting pins connected to the terminal on the other of the polarities and constituting the second pair are connected to a contact connecting signal cables respectively. One of the two conducting pins constituting the first pair is connected to a contact connecting a common signal cable. The polarity of a control signal is changed by exchanging the positions of the short circuit member 45.

3 Claims, 6 Drawing Sheets

ELECTRIC SIGNALS SUPPLYING DEVICE IN SOLENOID VALVE

BACKGROUND OF THE INVENTION

1. Field of the Invention

This invention relates to an electric signals supplying device in solenoid valve, for supplying electric power in a double-solenoid type valve having two solenoid coils.

2. Related Art Statement

The double-solenoid type valve has two solenoid coils for operating a valve body. For this type solenoid valves, as described in Japanese Utility Model Laid-Open No. 4-129981, such valves have been made that the opposite end portions of a valve housing are respectively provided with a solenoid coil, and that one end portion of the valve housing is only provided with two solenoid coils.

In the solenoid valve of this type having two solenoid coils, the number of terminals of coils is four in one solenoid valve. When a plurality of solenoid valves are mounted on a manifold block, the number of terminals of coils in a manifold solenoid valve, as described in the above-mentional Utility Model, amounts to a considerable number.

In order to save the number of wirings, there has been used a common terminal through which terminals on the same polarity of the respective coils are connected to.

For realization of saving the number of wirings, there has heretofore been practiced that two terminals on one of the polarity of the two coils are connected through a common terminal to a base plate mounted on a solenoid section of a solenoid valve, so that one contact connected to the common terminal is provided on a connector side.

In many solenoid valves, a terminal on the plus polarity of each of solenoid coils is used as a common terminal, and electric signals of the minus polarity for operating the solenoid valve are delivered to each of the terminals on the minus polarity side. In contrast thereto, there is a case where the terminal on the minus polarity side is used as the common terminal, and the electric signals of the plus polarity side are delivered to the terminal on the plus polarity side so as to operate the solenoid valve.

Which polarity is to be selected as the common terminal depends on how a fluid-pressure circuit having a solenoid valve is controlled. That is, some control circuits operate the solenoid valve by the electric signals of the minus polarity and the others operate it by the electric signals of the plus polarity. Accordingly, when the polarity of a control signal is changed due to changes of a production line or a production system in a factory where the solenoid valve is used, the polarity of the control signal is fixed in the solenoid valve, so that it becomes necessary to abandon the solenoid valve operated by the electric signals of the original polarity and change it over to the solenoid valve operated by the electric signals of the other polarity.

Furthermore, even when the solenoid valve is produced, it becomes necessary to prepare one solenoid valve operable on the signal of the plus polarity side and the other solenoid valve operable on the signal of the minus polarity side depending on the users, whereby not only the line for producing the solenoid valve but also handling of parts become complicated.

SUMMARY OF THE INVENTION

It is an object of the present invention to provide an electric signals supplying device in a solenoid valve, which can easily change the solenoid valve into one which is operated by both signals of the plus polarity and the minus polarity.

The above-described object and other ones, and novel features of the present invention will become more apparent from the description of the present specification in conjunction with the accompanying drawings.

The electric signals supplying device in a solenoid valve according to the present invention is a device for supplying electric signals to respective solenoid coils in a solenoid valve having two solenoid coils which control operation of respective valve members. The device comprises: a socket having two conducting pins constituting a first pair, which are respectively connected to a terminal on one of the polarities of said two solenoid coils, and further having two conducting pins constituting a second pair, which are respectively connected to a terminal on the other of the polarities of said two solenoid coils; a connector detachably mounted on said socket; a short circuit member detachably installed in said connector, which electrically connects the two conducting pins to each other of one of the pairs out of said first pair and said second pair; a first contact and a second contact, which are detachably installed in said connector, contacting said two conducting pins of the other of the pairs out of said first pair and the second pair, and connected thereto with signal cables respectively; and a third contact detachably installed in said connector, said third contact contacting one of the two conducting pins of said one of the pairs out of said first and second pairs, and being connected thereto with a common signal cable.

By exchanging the positions of the aforesaid short circuit member between the two pairs of the two conducting pins which constitute the first pair and the second pair of conducting pins, it can be easily determined whether the second pair of conducting pins is used for supplying signals while the first pair of conducting pins is used for the common terminal side, or, to the contrary, the first pair of conducting pins are used for supplying signals while the second pair is used for the common terminal side. Accordingly, changing between the polarities of signals for operating the solenoid coil, i.e., the plus common terminal or the minus common terminal can be achieved easily only by exchanging the positions of the short circuit member without changing the construction of the solenoid valve at all. In case of using the solenoid valve, even if the polarity of the signals is changed, the solenoid valve and the connector can be used as they are, so as to easily correspond to the mode of use. In case of producing the solenoid valves, it is enough to produce a single type solenoid valve which can correspond to the two modes of use without producing two types of the solenoid valve in accordance with the polarities of the signals, so that the manufacturing cost can be reduced.

DETAILED DESCRIPTION OF THE PREFERRED EMBODIMENT

Figure 1:
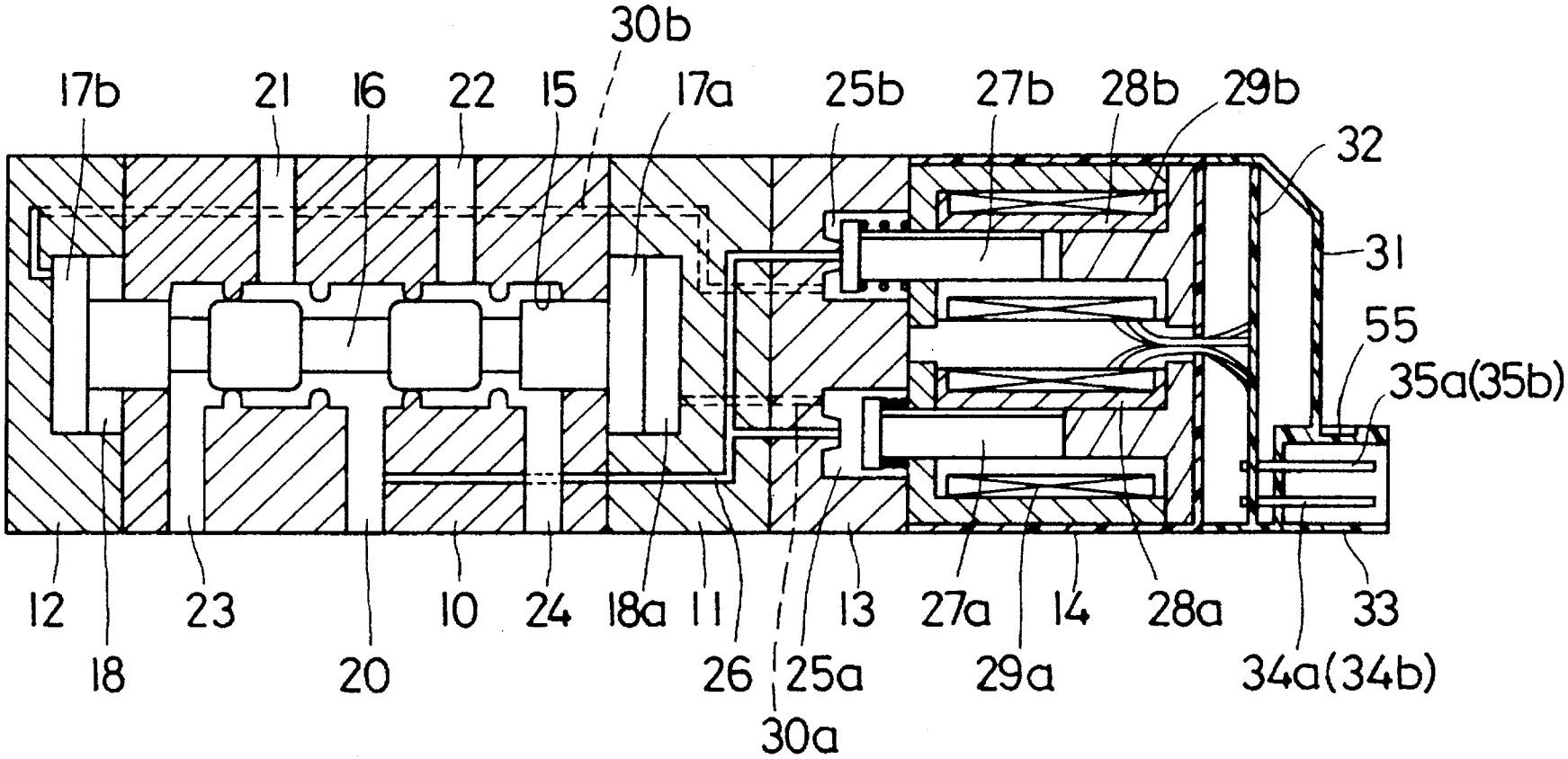
FIG. 1 is a sectional view showing a portion of the solenoid valve in one embodiment of the electric signals supplying device in the solenoid valve according to the present invention.
Figure 2:
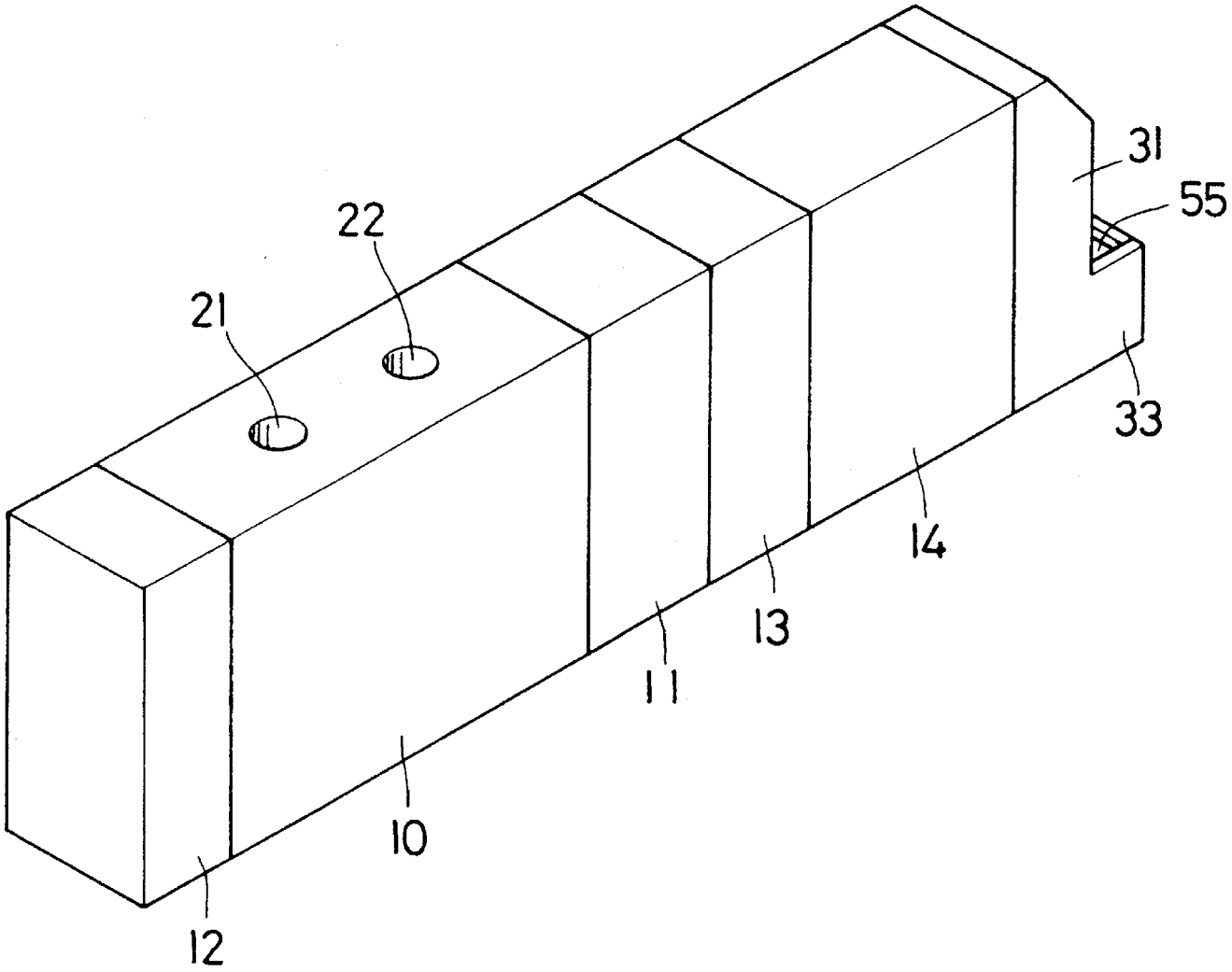
FIG. 2 is an oblique view showing the outer appearance of FIG. 1.

As shown in FIGS. 1 and 2, a solenoid valve comprises a valve housing 10 in a rectangular parallepiped shape, a first piston housing 11 and a second piston housing 12, which are provided on opposite ends of the valve housing 10. The first piston housing 11 is provided with a solenoid portion 14 through a pilot portion 13. Seal members, not shown, are provided between the above-described members constituting the solenoid valve, whereby air is prevented from leaking.

A shaft hole 15 is formed in the center of the valve housing 10, extending in the longitudinal direction. A spool shaft 16 is slidably mounted in the shaft hole 15 in the axial direction. A first piston 17*a* is provided at one end portion of the spool shaft 16, and a second piston 17*b* is provided at the other end portion of the shaft 16. The first piston 17*a* is housed in a fluid chamber 18*a* formed in the first piston housing 11, and the second piston 17*b* is housed in a fluid chamber 18*b* formed in the second piston housing 12.

An input port 20 is formed in the valve housing 10 so as to communicate with the shaft hole 15, and a first output port 21 is formed in the valve housing 10 so as to communicate with the input port 20 when the spool shaft 16 is moved to the left end in the device, as shown in FIG. 1. A second output port 22 is formed in the valve housing 10 so as to communicate with the input port 20 when the spool shaft 16 is moved to the right end in the drawing. Further, a first exhaust port 23 communicating with the first output port 21 and a second exhaust port 24 communicating with the second output port 22 are formed in the valve housing 10.

A first pilot chamber 25*a* and a second pilot chamber 25*b* are formed in the pilot section 13, and a pilot flow path 26 communicated with the input port 20 is opened into the pilot chambers 25*a* and 25*b*, respectively. Movable iron cores 27*a* and 27*b* are slidably provided in the axial direction in the solenoid section 14, each of said movable iron cores 27*a* and 27 having at the forward end thereof a valve body for opening and closing each of the openings.

The respective movable iron cores 27*a* and 27*b* are adapted to operate by passing of current to solenoid coils 29*a* and 29*b* which are wound around bobbins 28*a* and 28*b*, respectively. The first pilot chamber 25*a* is communicated with the first fluid chamber 18*a* through a first communicating flow path 30*a*, and the second pilot chamber 25*b* is communicated with the second fluid chamber 18*b* through a second communicating flow path 30*b*.

Accordingly, when a current is passed to the first solenoid coil 29*a*, as shown in FIG. 1, the fluid from the input port 20 flows into the first pilot chamber 25*a* through the pilot flow path 26, whereby the spool shaft 16 is moved to the left side by fluidal pressure acting on the first piston 17*a*. With this arrangement, the fluid from the input port 20 flows out of the first output port 21, and is supplied to a fluidal pressure component such as an air cylinder, not shown. The fluid is returned from the fluidal pressure component and flows into the second output port 22, and thereafter, flows out of the second exhaust port 24.

On the contrary, when the current is passed to the second solenoid coil 29*b*, the spool shaft 16 is moved to the right end in FIG. 1, the fluid from the input port 20 flows out of the second output port 22, and the fluid returned to the first output port 21 flows out of the first exhaust port 23.

When a plurality of solenoid valves having the above-described construction are mounted on a manifold block, not shown, the input ports 20 in the respective solenoid valves are communicated with a common supply flow path formed in the manifold block, and the respective exhaust ports 23 and 24 are also communicated with a common exhaust path.

A connector housing 31 is mounted on an end face of the solenoid section 14. A base plate 32 for a control circuit is provided on the connector housing 31, and assembled thereinto with a circuit for controlling the light of an LED (light emitting diode), not shown, for indicating the operating conditions of the solenoid valve and so forth. Further, the base plate 32 is connected thereto with cables on the plus polarity side and the minus polarity side for supplying electric power to the solenoid coils 29*a* and 29*b*.

Figure 3:
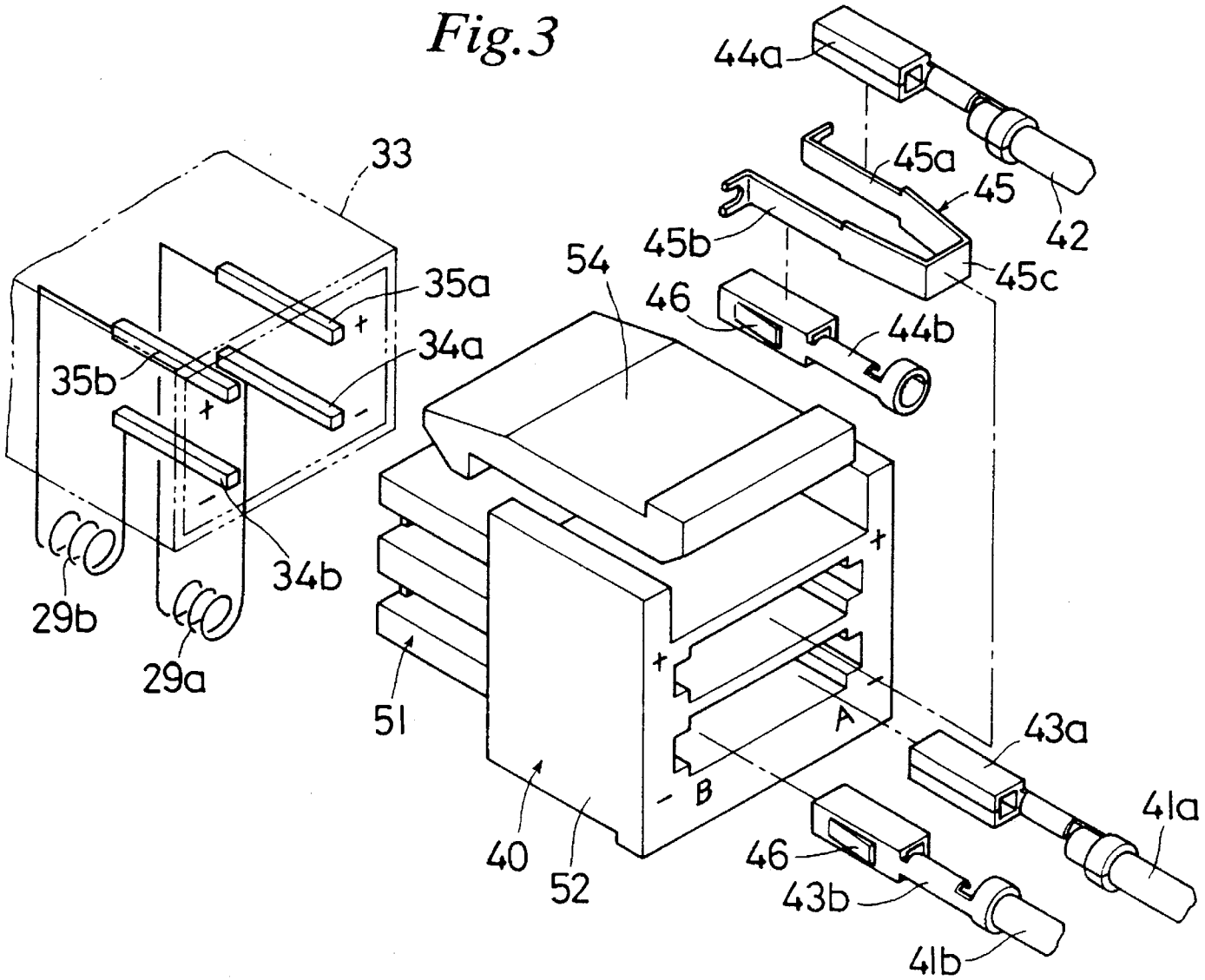
FIG. 3 is a disassembled oblique view showing a connector portion.
Figure 4:
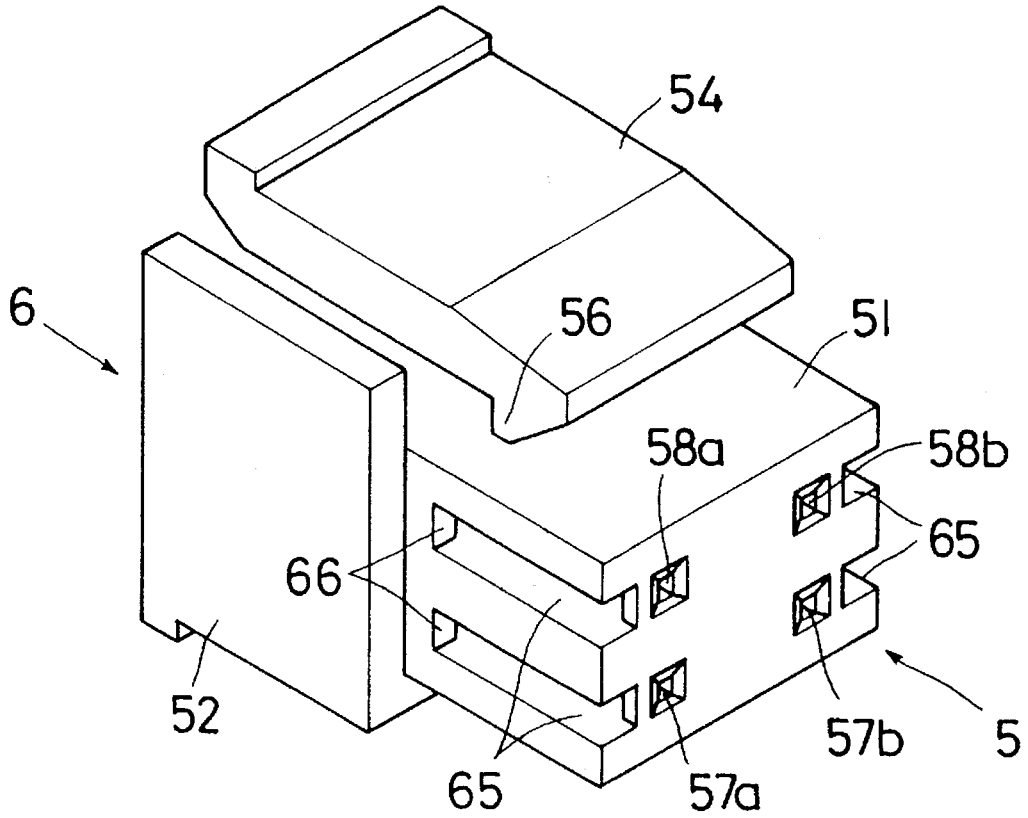
FIG. 4 is an oblique view showing the connector as viewed from the forward end portion thereof.
Figure 5:
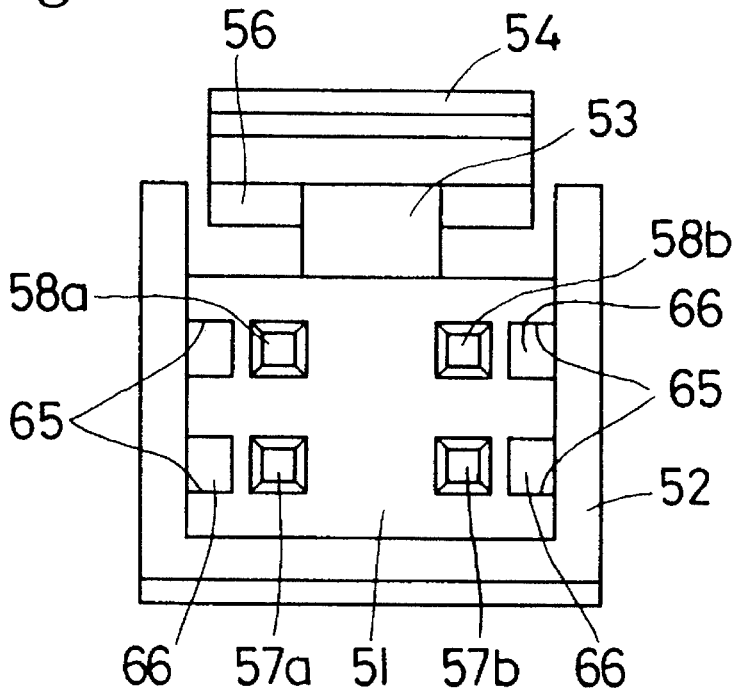
FIG. 5 is a front view showing the connector as viewed from a direction indicated in an arrow mark 5 in FIG. 4.

As shown in FIG. 3, a socket 33 is provided in the connector housing 31, and four conducting pins are mounted on the socket 33. A connecting end on the minus polarity side of the first solenoid coil 29*a* is connected to a conducting pin 34*a* on the minus polarity, and a connecting end on the plus polarity side of the first solenoid coil 29*a* is connected to a conducting pin 35*a* on the plus polarity side. Then, a connecting end on the minus polarity side of the second solenoid coil 29*b* is connected to a conducting pin 34*b* on the minus polarity side, and a connecting end on the plus polarity side of the second solenoid coil 29*b* is connected to a conducting pin 35*b* on the plus polarity side.

The two conducting pins 34*a* and 34*b*, which are electrically connected to the connecting ends on the minus polarity sides of the two solenoid coils 29*a* and 29*b*, form a pair of conducting pins having the polarities identical with each other. Similarly, the two conducting pins 35*a* and 35*b*, which are electrically connected to the connecting ends on the plus polarity side of the two solenoid coils 29*a* and 29*b*, form a pair of conducting pins having the polarities identical with each other. The conducting pins 35*a* and 35*b* form a first pair and the conducting pins 34*a* and 34*b* form a second pair, said first and second pairs being different in polarity from each other.

A connector 40 shown in FIGS. 3 through 8 is detachably inserted into a socket 33 of the connector housing 31. In this connector 40, there are detachably installed: a contact 43*a* provided with a signal cable 41*a* which is electrically connected to one of the connecting ends or the connecting end on the minus polarity side of the first solenoid coil 29*a* in the illustration, through the conducting pin 34*a*; and a contact 43*b* provided with a signal cable 41*b* which is electrically connected to one of the connecting ends or the connecting end on the minus polarity side of the second solenoid coil 29*b* in the illustration, through the conducting pin 34*b*. That is, the two conducting pins 34*a* and 34*b* which constitute the second pair are connected thereto with the contacts 43*a* and 43*b*, respectively.

Further, in the connector 40, there are detachably installed: a contact 44*a* provided with a signal cable 42 for the common use which is electrically connected to the other of the connecting ends of the first solenoid coil 29*a* through the conducting pin 35*a*; and a contact 44*b* electrically connected to the other of the connecting ends of the second solenoid coil 29*b* through the connecting pin 35*b*. The three signal cables 41*a*, 41*b* and 42 as shown in FIG. 3 are respectively connected to a signal generating source such as a solenoid valve operation control device, not shown.

All of the four contacts 43*a*, 43*b*, 44*a* and 44*b* have the shapes and constructions identical with one another, however, no signal cable is connected to the contact 44*b*, whereby the contact 44*b* serves as a dummy one. By use of a short circuit member 45 detachably installed in the connector 40, i.e., a receptacle, the two conducting pins 35*a* and 35*b* of the second pair are electrically connected to each other through the contacts 44*b* and 44*a*. The short circuit member 45 includes two contacting portions 45*a*, 45*b* and a connecting portion 45*c* connecting the two contacting portions 45*a* and 45*b* to each other.

Accordingly, when a signal is applied to the signal cable 41*a*, the current passes through the signal cable 42 for the common use, and electric power is supplied to the first solenoid coil 29*a*. On the Other hand, when a signal is applied to the signal cable 41*b*, the current passes through the short circuit member 45 and the signal cable 42 for the common use, and the electric power is supplied to the second solenoid coil 29*b*. That is, in the illustration, the respective plus polarity sides of the coils serve as the common use. When the signal cable 42 is fastened to the contact 44*b* contacting a conducting pin 35*b*, without fastening the signal cable 42 on the contact 44*a*, the plus polarity side can be made to be the common side similarly.

In contrast thereto, if the contact 44*b* provided with no signal cable, i.e., the contact for conducting is connected to one of the conducting pins 34*a* and 34*b* constituting the second pair on the minus polarity side, and one signal cable is connected to the other of the conducting pins through the short circuit member 45, the minus polarity side can be made to be the common side. As described above, by exchanging the positions of the short-circuit member 45, either the connecting mode of the plus common or the minus common can be easily corresponded to.

Figure 6:
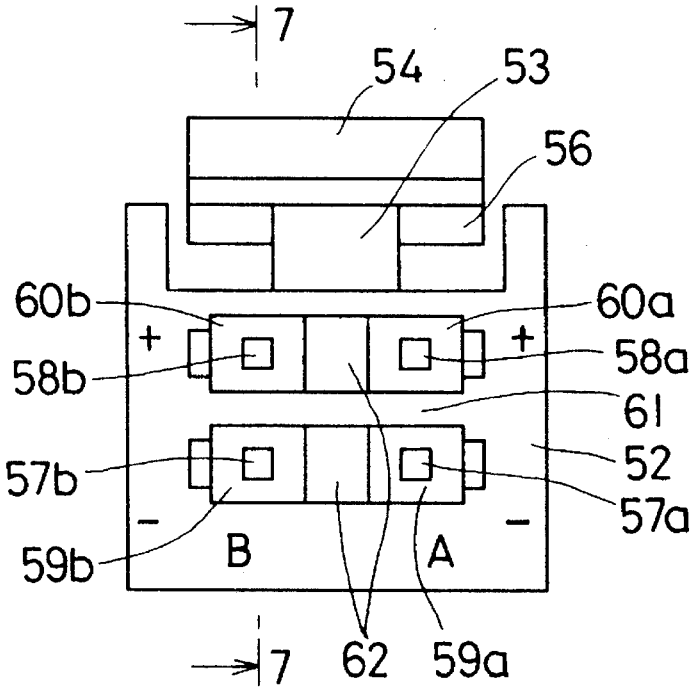
FIG. 6 is a rear view showing the connector as viewed from a direction indicated in an arrow mark 6 in FIG. 4.
Figure 7:
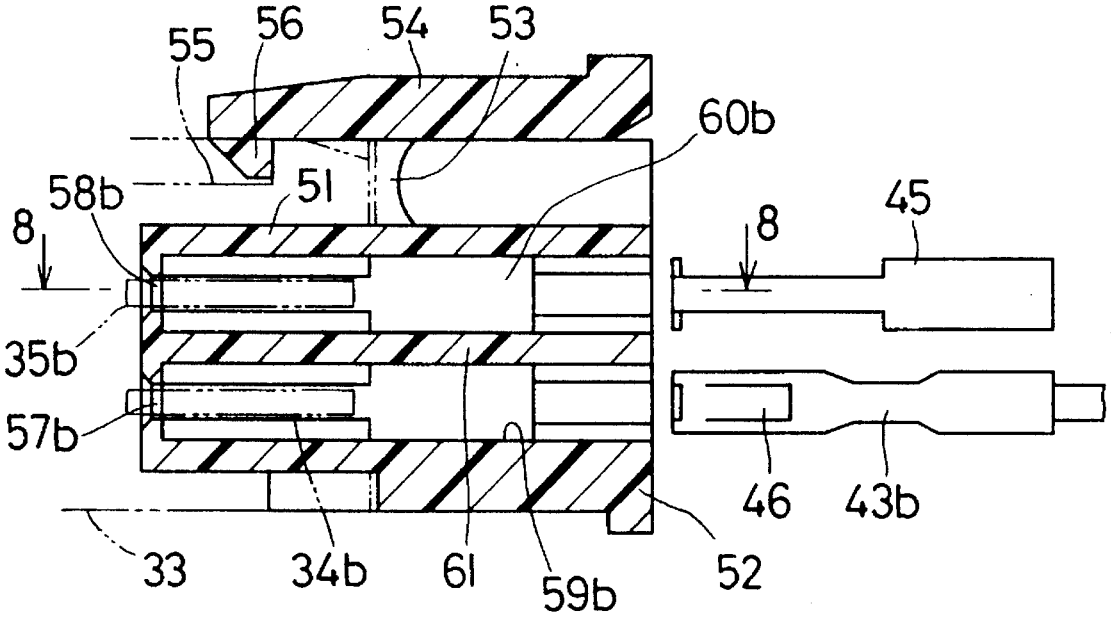
FIG. 7 is a sectional view showing the connector as viewed from the line 7—7 indicated in arrow marks in FIG. 6.

As shown in FIGS. 3 through 8, the connector 40 includes a forward end portion 51 coupled to the socket 33 of the connector housing 31, and a base end portion 52 larger in the widthwise dimension than the forward end portion, and all of them are integrally formed of resin. An engageable lever 54 is integrated on the base end portion 52 through a connecting piece 53, and an engageable projection 56 engageable with an engageable groove 55 formed in the socket 33 is provided on the forward end of the engageable lever 54 as shown in FIG. 7.

In the forward end portion 51, insertion openings 57*a*, 57*b*, 58*a* and 58*b* are formed, into which the aforesaid conducting pins 34*a*, 34*b*, 35*a* and 35*b* are inserted, respectively. Four receiving holes 59*a*, 59*b*, 60*a* and 60*b* are formed in the forward end portion 51 and the base end portion 52 in correspondence with the respective insertion openings as shown in FIG. 6. The respective receiving holes are divided from one another by a partition wall 61 in the lateral direction for partitioning the plus polarity side from the minus polarity side, and by a partition wall 62 in the longitudinal direction for partitioning the side of the first solenoid coil 29*a* and the side of the second solenoid coil 29*b*. The contacts 43*a*, 43*b* and 44*a* to which the signal cables 41*a*, 41*b* and 42 are connected, and the contact 44*b* to which no signal cable is connected, are inserted into the receiving holes, respectively.

Figure 8:
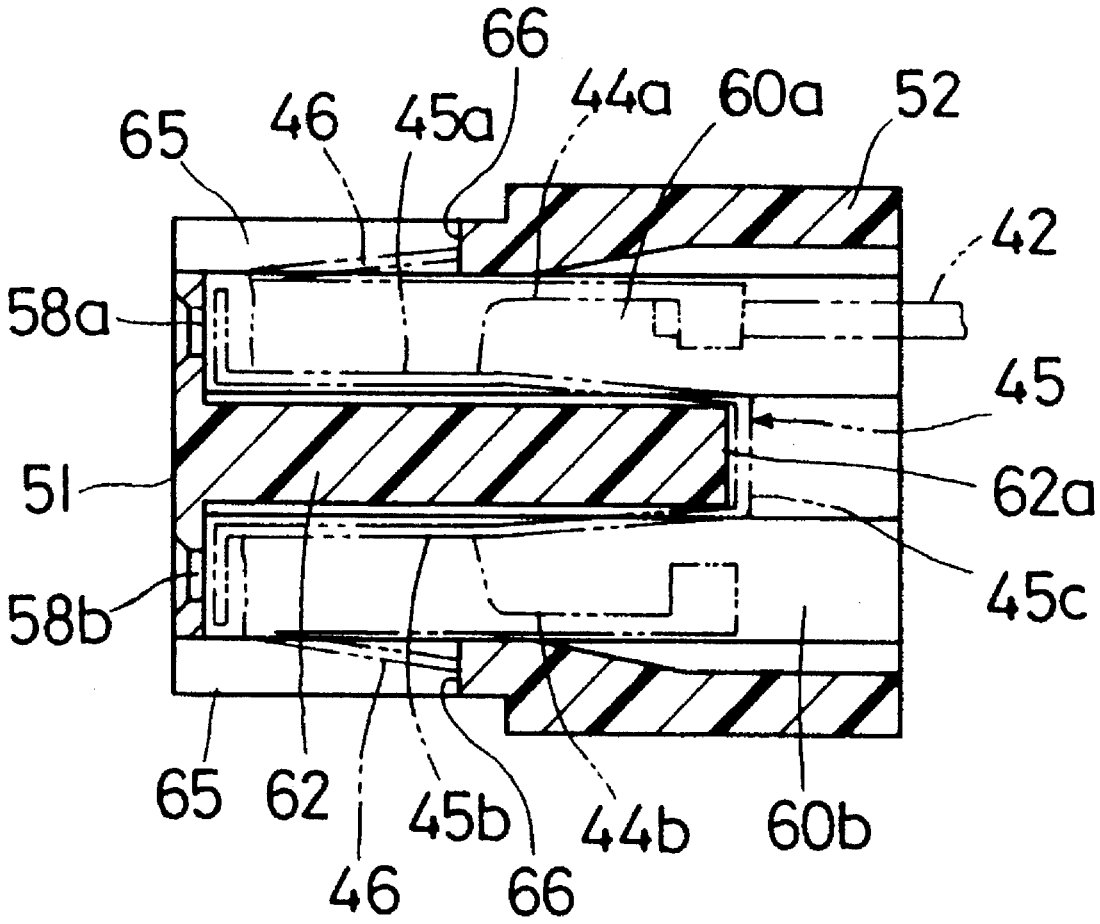
FIG. 8 is a sectional view showing the connector as viewed from the line 8—8 indicated in arrow marks in FIG. 7.

In the illustration, the short circuit member 45 is inserted into the two receiving holes 60*a* and 60*b* for the second pair of conducting pins into which the two conducting pins 35*a* and 35*b* on the plus polarity side are inserted, in such a manner that the short circuit member 45 surrounds the partition wall 62 in the longitudinal direction. As shown in FIG. 8, the connecting portion 45*c* is located at a rear end face 62*a* of the partition wall 62 which is positioned to be retracted from a rear end face of the base end portion 52 toward the forward end portion, and the contacting portions 45*a* and 45*b* are extended in the respective receiving holes 60*a* and 60*b* to be brought into contact with the contacts 44*a* and 44*b*.

In FIG. 7, two-dot chain lines indicate that the conducting pins 34*b* and 35*b* are inserted into the two receiving holes 59*b* and 60*b*, and solid lines indicate a state of the short circuit member 45 and the contact 43*b* before the conducting pins 34*b* and 35*b* are inserted into the receiving holes. In FIG. 8, two-dot chain lines indicate the two contacts 44*a* and 44*b* and the short circuit member 45 in which the contacts 44*a* and 44 are received into the two receiving holes 60*a* and 60*b*, into which are inserted the conducting pins of the second pair, and the short circuit member 45 is electrically connects the conducting pins to each other through the two contacts 44*a* and 44*b*.

As shown in FIGS. 3 and 8, each of the four contacts 43*a*, 43*b*, 44*a* and 44*b* are formed thereon with an engageable pawl 46, and when each of the contacts is inserted into the receiving holes, an opening end of each of the engageable pawls 46 is projected into a slit 65 communicated with each of the receiving holes and formed in the forward end portion 51, and then the engageable pawl 46 is engaged with an engageable end face 66. With this arrangement, the respective contacts are prevented from falling off, and when the contact is pulled out in a state where the engageable pawl 46 is retracted by use of a tool or the like, the contact can be easily removed from the connector 40.

In order to assemble the aforesaid connector 40, the three contacts 43*a*, 43*b* and 44*a* to which the signal cables 41*a*, 41*b* and 42 are connected respectively, and the contact 44*b* for conducting to which no signal cable is connected, and the short circuit member 45, are inserted into the receiving holes 59*a*, 59*b*, 60*a* and 60*b* respectively. When they are inserted to the end of insertion, the engageable pawl 46 is engaged with the engageable end face 66, whereby the respective signal cables are prevented from falling off.

In this state, the connector 40 is inserted into the socket 33 of the connector housing 31 of the solenoid valve. When the connector 40 is inserted to the end of insertion, the engageable projection 56 of the engageable lever 54 enters into the engageable groove 55 of the socket 33, so that the connector 40 will be prevented from falling off.

In order to operate the solenoid valve assembled as described above, when a signal of the minus polarity is applied from the signal cable 41*a*, the current passes through the first solenoid coil 29*a* shown in FIG. 1, the movable iron core 27*a* is retracted, whereby the spool shaft 16 is moved to the left end as shown in FIG. 1. On the other hand, when a signal of the minus polarity is applied from the signal cable 41*b*, the spool shaft 16 is moved from the position shown in FIG. 1 to the right end.

Subsequently, when the mode of use of the aforesaid plus common is changed to the minus common by using the same solenoid valve, the contacts 43*a* and 43*b* to which the signal cables 41*a* and 41*b* are connected, are inserted into the receiving holes 60*a* and 60*b* so as to electrically connect the contacts 43*a* and 43*b* to the first pair of conducting pins 35*a* and 35*b*, respectively. Then, the contact 44*a* to which the signal cable 42 for the common use is connected, is electrically connected to one of the second pair of conducting pins 34*a* and 34*b*, and the contacts 44*a* and 44*b* are inserted into the receiving holes 59*a* and 59*b* respectively, so as to electrically connect the contact 44*b* for conducting to the other of the second pair of conducting pins 34*a* and 34*b*. Then, the short circuit member 45 is previously inserted into the receiving hole for the second pair of conducting pins, whereby the respective contacts 44*a* and 44*b* are electrically connected to each other through the short circuit member 45.

Accordingly, when the positions of the short circuit member 45 is exchanged and the signal cables for the common use are connected to each other through this short circuit member 45, the polarity of the common terminal can be easily changed by the exchange of positions of the short circuit member 45 without any changes of the construction of the solenoid valve.

As has been described hereinabove, the invention developed by the inventor of the present invention has been described in detail with reference to the embodiment. However, the present invention should not necessarily be limited to the above embodiment and it is needless to say that the present invention can be variously modified within the scope of the technical gist.

For example, as the contact 44*b* for conducting, the contact identical in construction with another contact has been used, however, only if the contact of this type can electrically conduct the conducting pin with the signal cable for the common use, any members different in shape from other contacts may be adopted as the contact for conducting. Furthermore, only if the short circuit member 45 is changed in its configuration, the short circuit member capable of being directly and electrically connected to the conducting pin may be used without using the contact for conducting.

Further, in the illustration, the present invention is applicable-even in the case where solenoid portions are provided on both opposite ends of the solenoid valve.

What is claimed is:

1. An electric signals supplying device in a solenoid valve, which supplies electric signals to respective solenoid coils in said solenoid valve having two solenoid coils which control operations of respective valve members, said device comprising:

a socket having two conducting pins constituting a first pair, which are respectively connected to a terminal on one of the polarities of said two solenoid coils, and further having two conducting pins constituting a second pair, which are respectively connected to a terminal on the other of the polarities of said two solenoid coils;

a connector detachably mounted on said socket;

a short circuit member detachably installed in said connector, which electrically connects the two conducting pins to each other of one of the pairs out of said first pair and said second pair;

a first contact and a second contact, which are detachably installed in said connector, contacting said two conducting pins of the other of the pairs out of said first pair and the second pair, and connected thereto with signal cables respectively; and a third contact detachably installed in said connector, said third contact contacting one of the two conducting pins of said one of the pairs out of said first and second pairs, and being connected thereto with a common signal cable.

2. An electric signals supplying device in a solenoid valve as set forth in claim 1, further comprising a contact for conducting, which is detachably installed in said connector, connected to the other of the two conducting pins of said one of the pairs, has a similar shape to other respective contacts, and is not connected thereto with the signal cable, wherein the two conducting pins of the said other of the pairs are electrically connected to each other through said contact.

3. An electric signals supplying device in a solenoid valve as set forth in claim 1, wherein said device has a solenoid section in which said two solenoid coils are arranged in parallel to each other, and said socket is mounted to said solenoid section.

* * * * *